US007454824B2

(12) United States Patent
Chen

(10) Patent No.: US 7,454,824 B2
(45) Date of Patent: Nov. 25, 2008

(54) APPARATUS FOR INSERTING A SLIDE UNIT ONTO A CLAMPING HEAD OF A PLASTIC ZIPPER BAG

(76) Inventor: Chun-Shan Chen, P.O. Box 90, Tainan City 70499 (TW)

( * ) Notice: Subject to any disclaimer, the term of this patent is extended or adjusted under 35 U.S.C. 154(b) by 266 days.

(21) Appl. No.: 11/439,979

(22) Filed: May 25, 2006

(65) Prior Publication Data

US 2007/0271776 A1 Nov. 29, 2007

(51) Int. Cl.
*B21D 53/54* (2006.01)
*B21F 45/18* (2006.01)
*A41H 37/06* (2006.01)

(52) U.S. Cl. ..... 29/409; 29/768; 29/408; 29/410; 29/766; 29/33.2

(58) Field of Classification Search ..... 29/408, 29/409, 410, 766, 768, 33.2; 24/428
See application file for complete search history.

(56) References Cited

U.S. PATENT DOCUMENTS 6,973,704 B2 * 12/2005 Cortigiano, Sr. ..... 29/409

* cited by examiner

*Primary Examiner*—David P Bryant
*Assistant Examiner*—Sarang Afzali

(57) ABSTRACT

An installed structure of a slide unit of a clamping head on a zipper bag has a vibration device, a track and an installation device. The installation device is installed with a removing unit, an input unit and a press unit so that a clamping portion is delivered to a removing unit. A removing sheet of the removing unit serves to open the closed clamping portion. The slide unit of the clamping head is pushed to be installed in the clamping portion of the zipper bag. The open clamping portion is closed again by use of two corresponding rolling wheels of the press unit pressing. The slide unit of the clamping head is installed automatically at the clamping portion of the zipper bag. The assembly procedure is continuous, convenient and fast. The installed structure is available to be mass production, reduce manufacture costs and fit in with economic efficiency.

1 Claim, 9 Drawing Sheets

APPARATUS FOR INSERTING A SLIDE UNIT ONTO A CLAMPING HEAD OF A PLASTIC ZIPPER BAG

FIELD OF THE INVENTION

The present invention relates to zipper devices, and in particular to an installed structure of a slide unit of a clamping head on a zipper bag. By use of installing automatically the slide unit of the clamping head on a clamping portion of the zipper bag, the assembly procedure of the present invention is continuous automatically so as to be convenient and fast very much. The present invention reduces many manufacture costs and enhance thereof productivity so as to fit in with manufacturers' economic demands and manufacture process efficiency.

BACKGROUND OF THE INVENTION

According to prior arts of a slide unit of a clamping head on a plastic zipper bag, referring to FIG. 1, the slide unit 92 of the clamping head is installed at the top edge of a clamping portion 91 of an opening 90 of the zipper bag 9. By sliding the slide unit 92 of the clamping head on the clamping portion 91, the opening 90 of the zipper bag 9 is available to be opened or closed. However, when the slide unit 92 of the clamping head is assembled at the opening 90 of the zipper bag 9 of the prior arts, the lower slide unit 92 of the clamping head should be pulled outwards opening firstly in order to enlarge the open of the lower slide unit 92 of the clamping head. Thereby, the slide unit 92 of the clamping head is installed at the clamping portion 91 of the zipper bag 9. A removing sheet of the slide unit 92 of the clamping head removes the clamping portion 91 and inserts in the center thereof so that the assembly is finished finally.

However, when the slide unit 92 of the clamping head of the prior art is installed at the clamping portion 91, the lower part of the slide unit 92 of the clamping head should be pulled outwards to open (referring to FIG. 2). The slide unit 92 of the clamping head is subjected to a change in shape due to the excessive pulling force which could result in breakage of the slide unit 92 of the clamping head resulting in a loss of manufacturing cost. In addition, the assembly of the prior art requires an additional manpower as a worker has to manually pull open each lower part of the slide unit 92 of the clamping head one by one. The assembly processes of the prior arts result in loss of manpower and assembly time. In today's ever evolving business environment, a manufacturing procedure should be simple, convenient and fast in order to win a company any competitive edge. If a manufacturing procedure requires manual assembly by hands, the productivity is not only limited but would result in loss of manpower and manufacturing inefficiency. The continuous and automatic assembly is capable of enhancing productivity and reducing manufacture costs which would result in a more competitive edge. Therefore, the novelty of the present invention serves to overcome the above-mentioned defects of the prior arts and improve the assembly procedure of the slide unit of the clamping head on the zipper bag.

SUMMARY OF THE INVENTION

The primary objective of the present invention is to provide a convenient and fast assembly procedure for the slide unit of the clamping head on the zipper bag. The present invention is available to be mass production, reduce manufacture costs and fit in with economic efficiency.

To achieve above object, the present invention provides an installed structure of a slide unit of a clamping head on a zipper bag which has a vibration device, a track and an installation device installed on a base frame. The installation device is installed with a retaining seat. The retaining seat is installed with a removing unit, an input unit and a press unit. The removing unit is installed with a groove. A front side of the groove has a notch for receiving a clamping portion of a zipper bag. The closed clamping portion of the zipper bag can pass through the notch. A removing sheet is installed in the groove for removing the closed clamping portion to open so that the slide unit of the clamping head is installed. The input unit is installed below the track. The input unit is installed with a push rod. The push rod is used to push the slide unit to the zipper bag. The press unit is on the one side of the input unit. The press unit is corresponding to be a rolling wheel so as to press an opening of the clamping portion closely. The corresponding rolling wheel gets moving by use of an air pressure device. The air pressure device is capable of enlarging the gap between the corresponding rolling wheels so that the slide unit of the clamping head is available to pass through.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
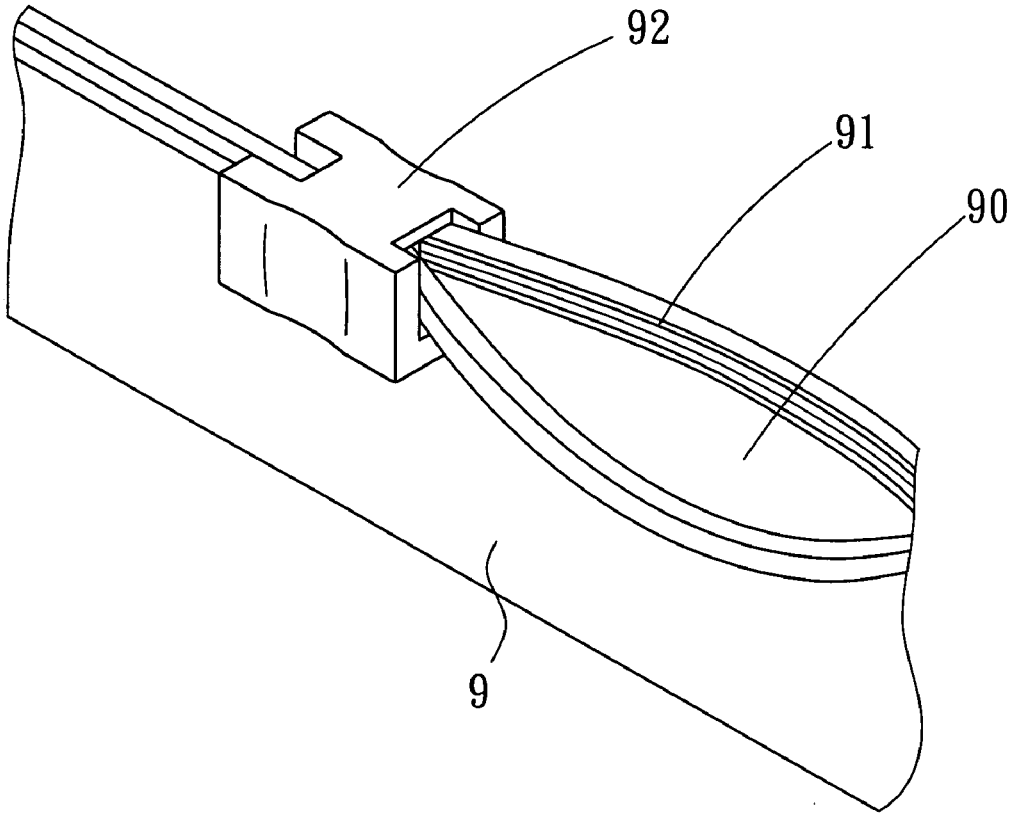
FIG.1 (PRIOR ART)
FIG. 1 is an assembled perspective view of the slide unit of the clamping head on the zipper bag of the prior art.
Figure 2:
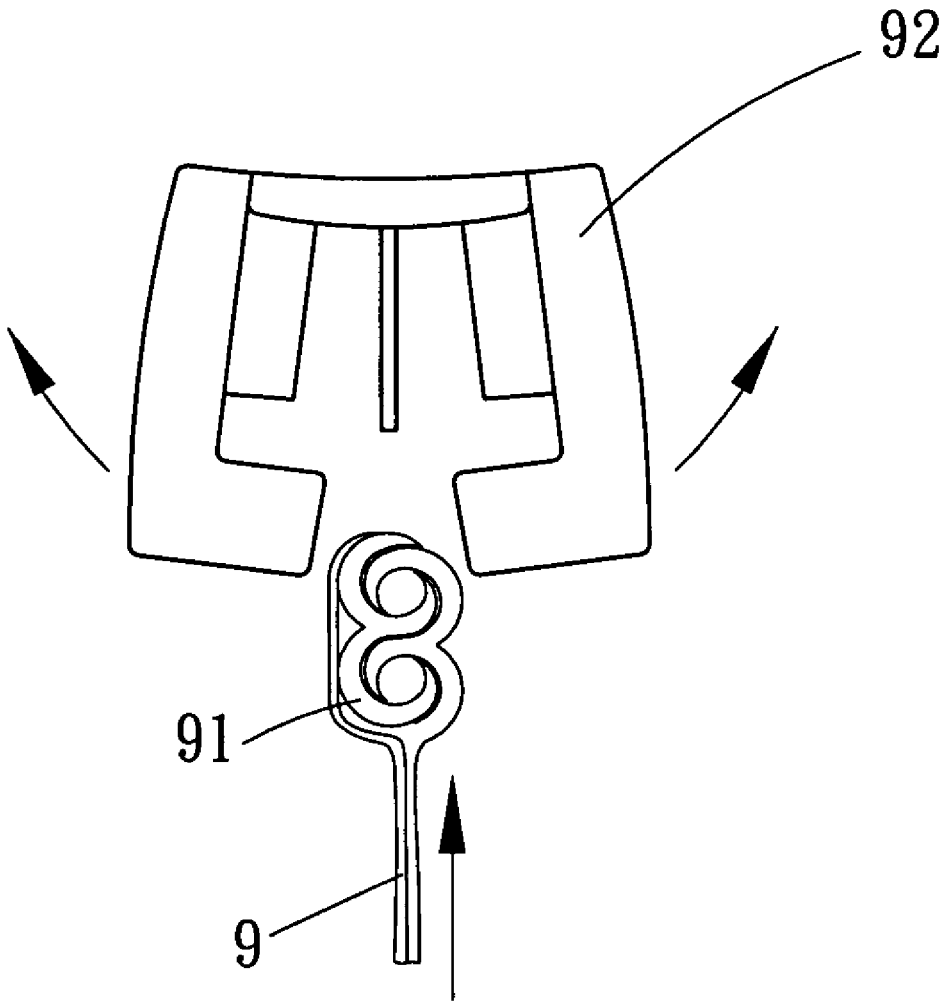
FIG.2 (PRIOR ART)
FIG. 2 is illustrated to stretch outwards the slide unit of the clamping head of the prior art.
Figure 3:
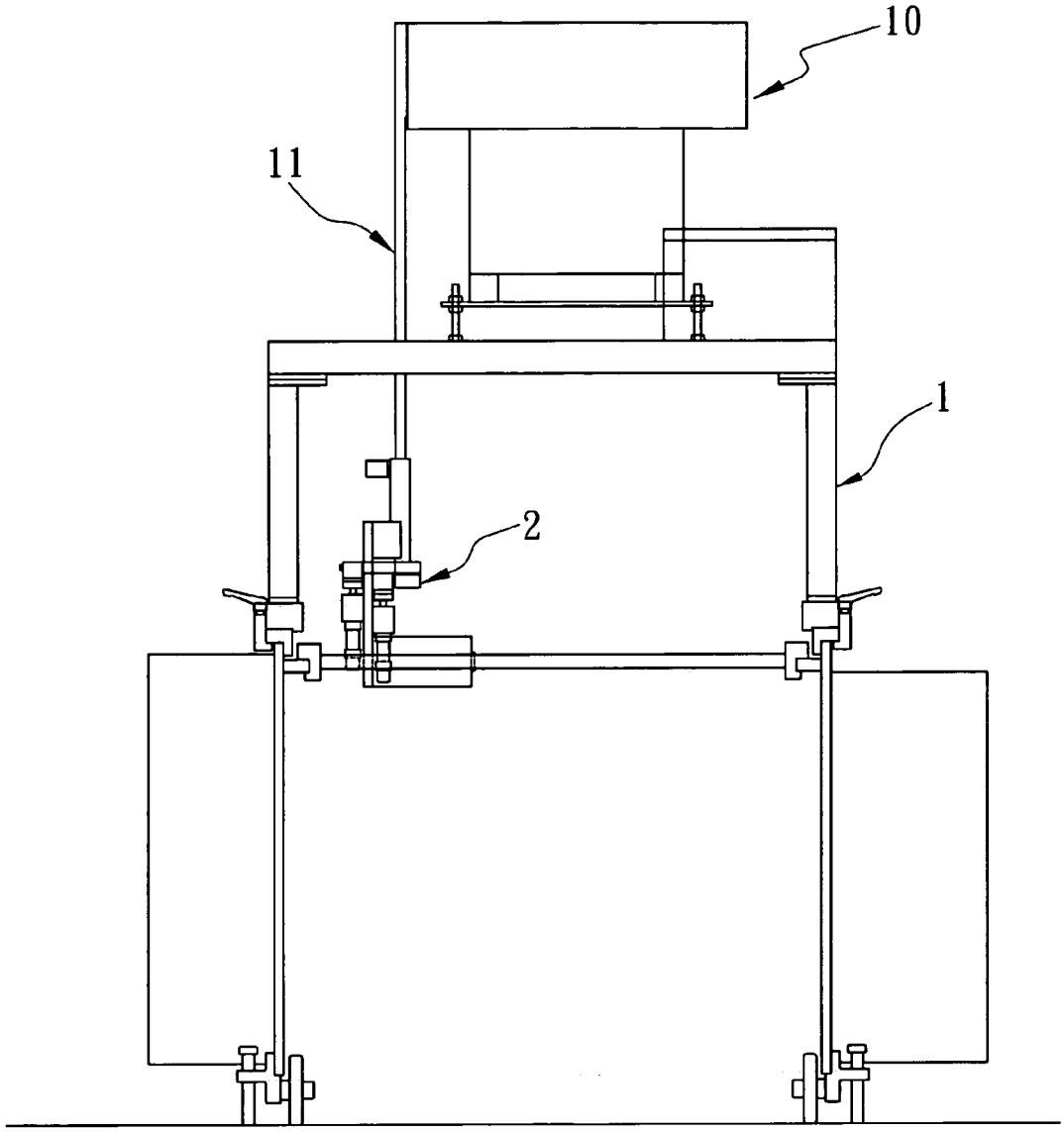
FIG. 3 is an assembled perspective view of the present invention.
Figure 4:
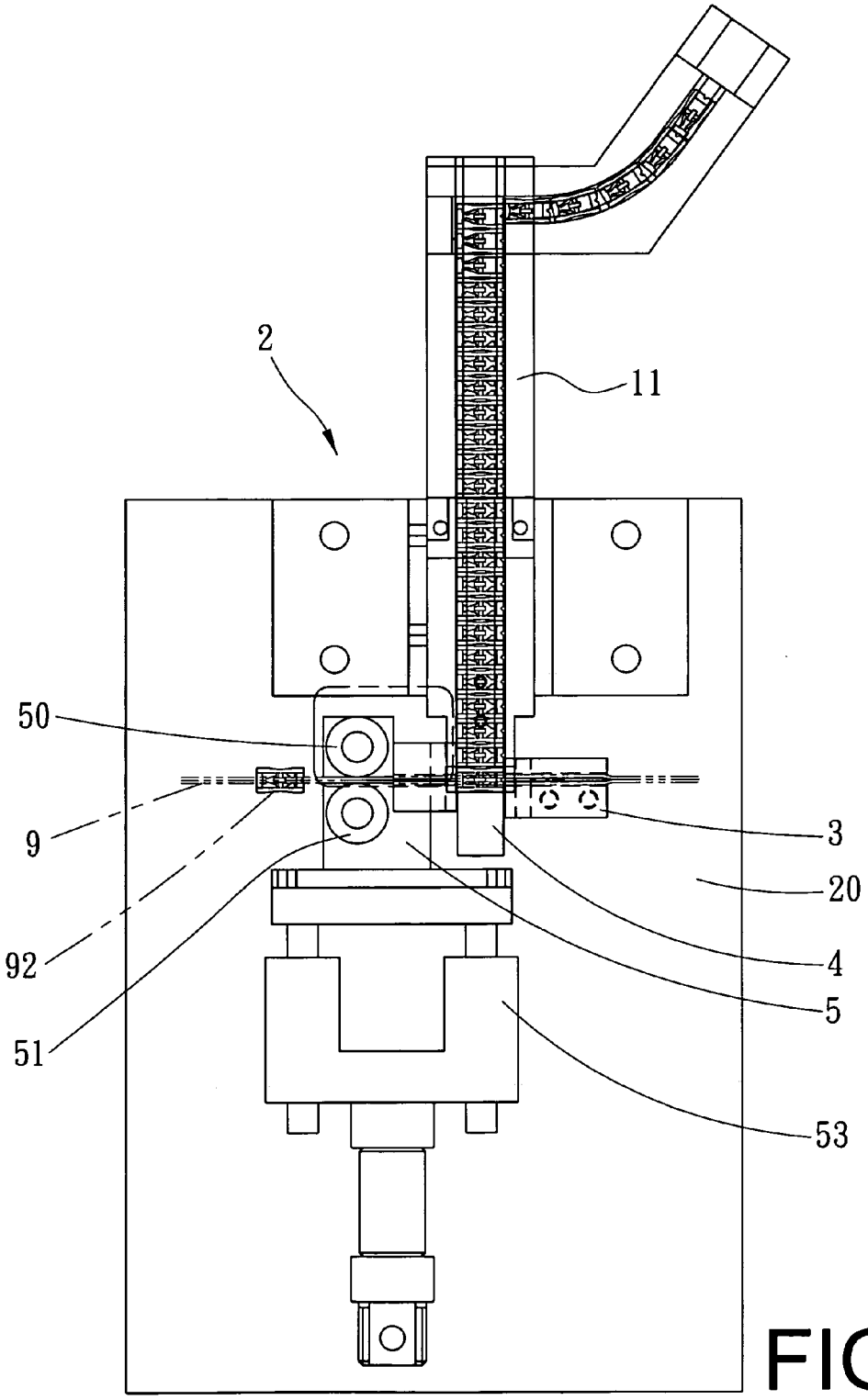
FIG. 4 is a front view of the installation device of the present invention.
Figure 5:
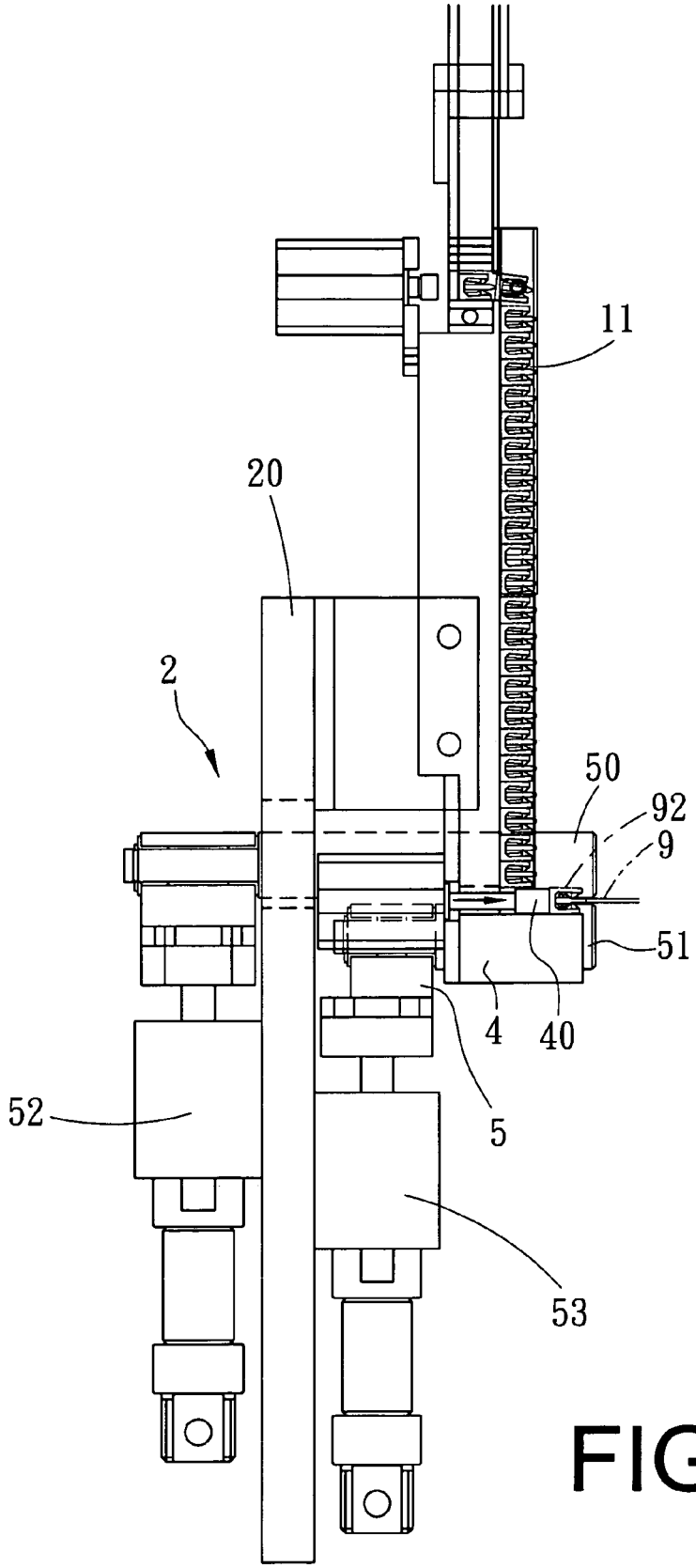
FIG. 5 is a lateral view of the installation device of the present invention.
Figure 6:
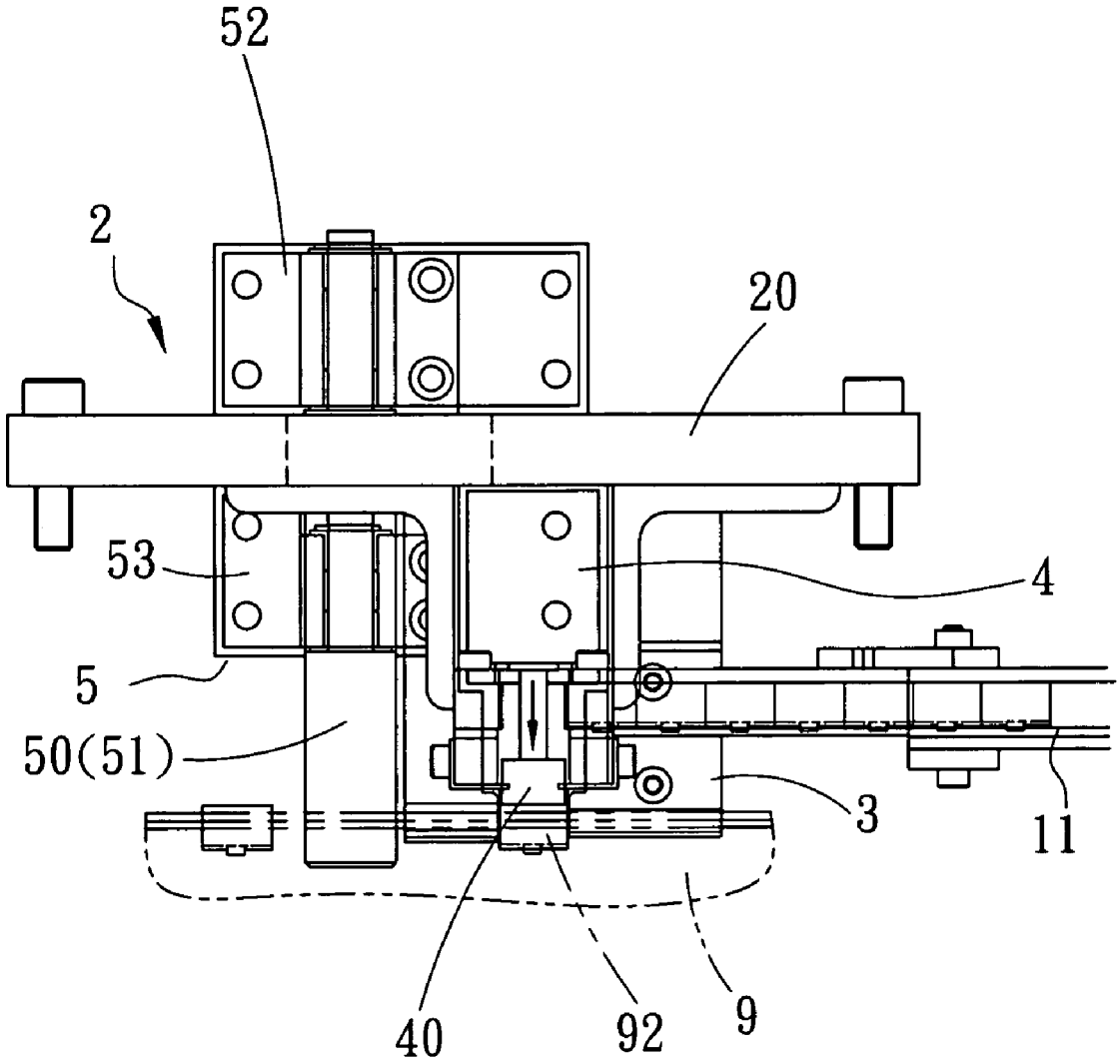
FIG. 6 is a vertical view of the installation device of the present invention.
Figure 7C:
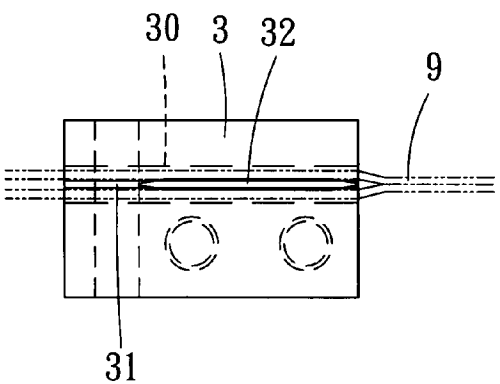
FIG. 7C is a vertical view of the removing unit of the installation device of the present invention.
Figure 7B:
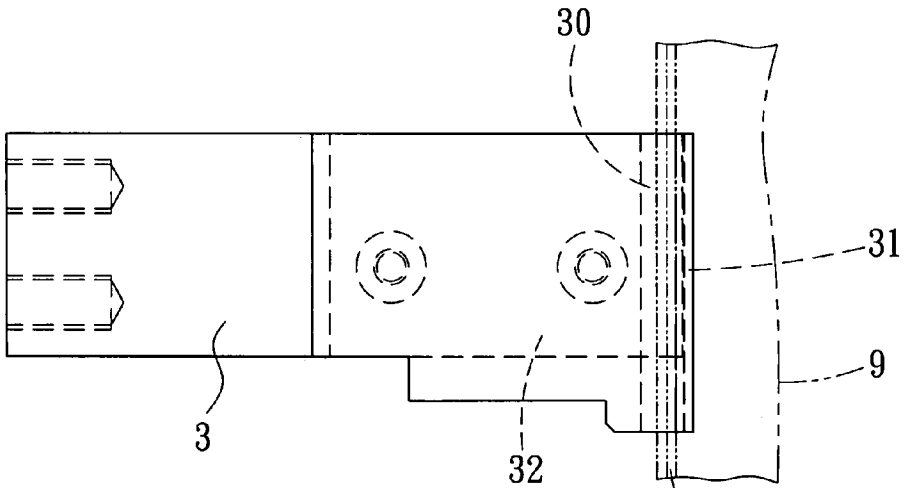
FIG. 7B is a lateral view of the removing unit of the installation device of the present invention.
Figure 7A:
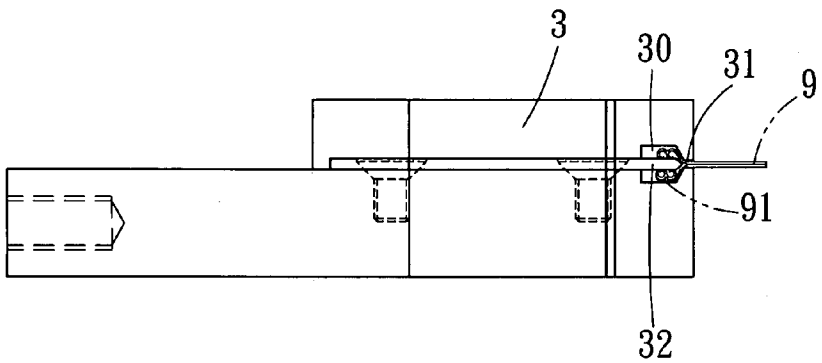
FIG. 7A is a front view of the removing unit of the installation device of the present invention.

Referring to FIG. 3, the structure of the present invention is illustrated. In the present invention, a vibration device 10, a track 11 and an installation device 2 is installed on a base frame 1. Referring to FIGS. 4, 5, and 6, the installation device 2 is installed with a retaining seat 20. The retaining seat 20 is installed with a removing unit 3, an input unit 4 and a press unit 5. Referring to FIGS. 7A, 7B, and 7C, the removing unit 3 is installed with a groove 30. A front side of the groove 30 has a notch 31 for receiving a clamping portion 91 of a zipper bag 9. The closed clamping portion 91 of the zipper bag 9 can pass through the notch 31. A removing sheet 32 is installed in the groove 30. As the removing sheet 32 is removed by the closed clamping portion 91, an opening 90 of the zipper bag 9 is formed so that a slide unit 92 of a zipper clamping head is placed therein. The input unit 4 is installed below the track 11. The input unit 4 is installed with a push rod 40. The push rod 40 is used to push the slide unit 92 to the zipper bag 9 so as to form an opening on the clamping portion 91. The press unit 5 is on the one side of the input unit 4. The press unit 5 has two rolling wheels 50 and 51. The two rolling wheels 50 and 51 get moving by two air pressure devices 52 and 53.

In assembling, referring to FIGS. 3 to 9, the slide unit 92 is installed into the vibration device 10 firstly. The clamping portion 91 of the zipper bag 9 is installed in the groove 30 of the removing unit 3 by passing through installation device 2. The closed clamping portion 91 is opened by the removing sheet 32 in the groove 30 so as to the slide unit 92 capable of being installed. Then, by use of the vibration device 10, the slide unit 92 is vibrated and guided to the track 11 so as to deliver thereof in order. The track 11 delivers the slide unit 92 of clamping head to the input unit 4 of the installation device 2. By use of moving the push rod 40 of the input unit 4, the slide unit 92 of the clamping head is pushed forwards and installed at opening the clamping portion 91 of the zipper bag 9.

Figure 8:
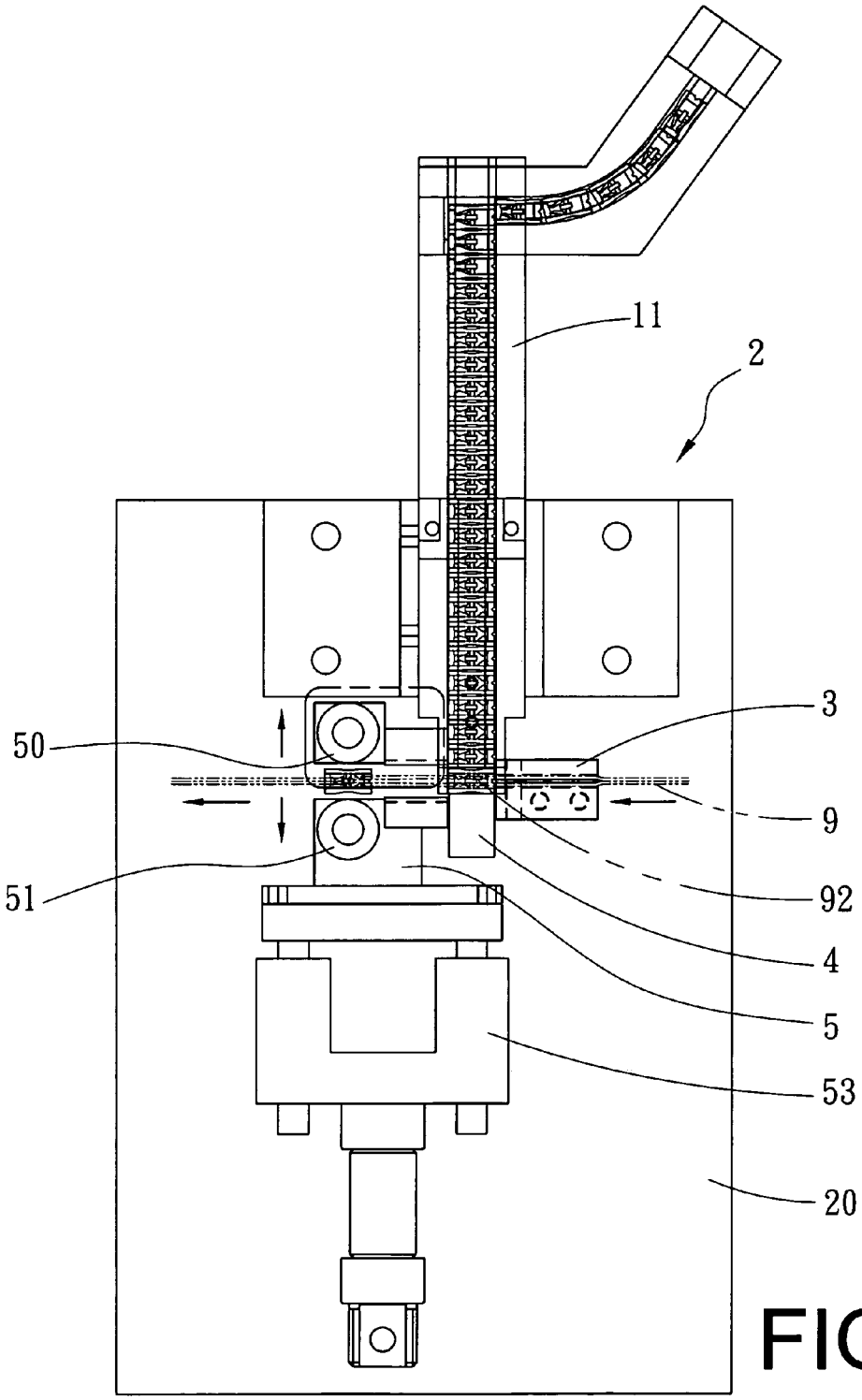
FIG. 8 is a front view of spreading the press unit of installation device of the present invention.
Figure 9:
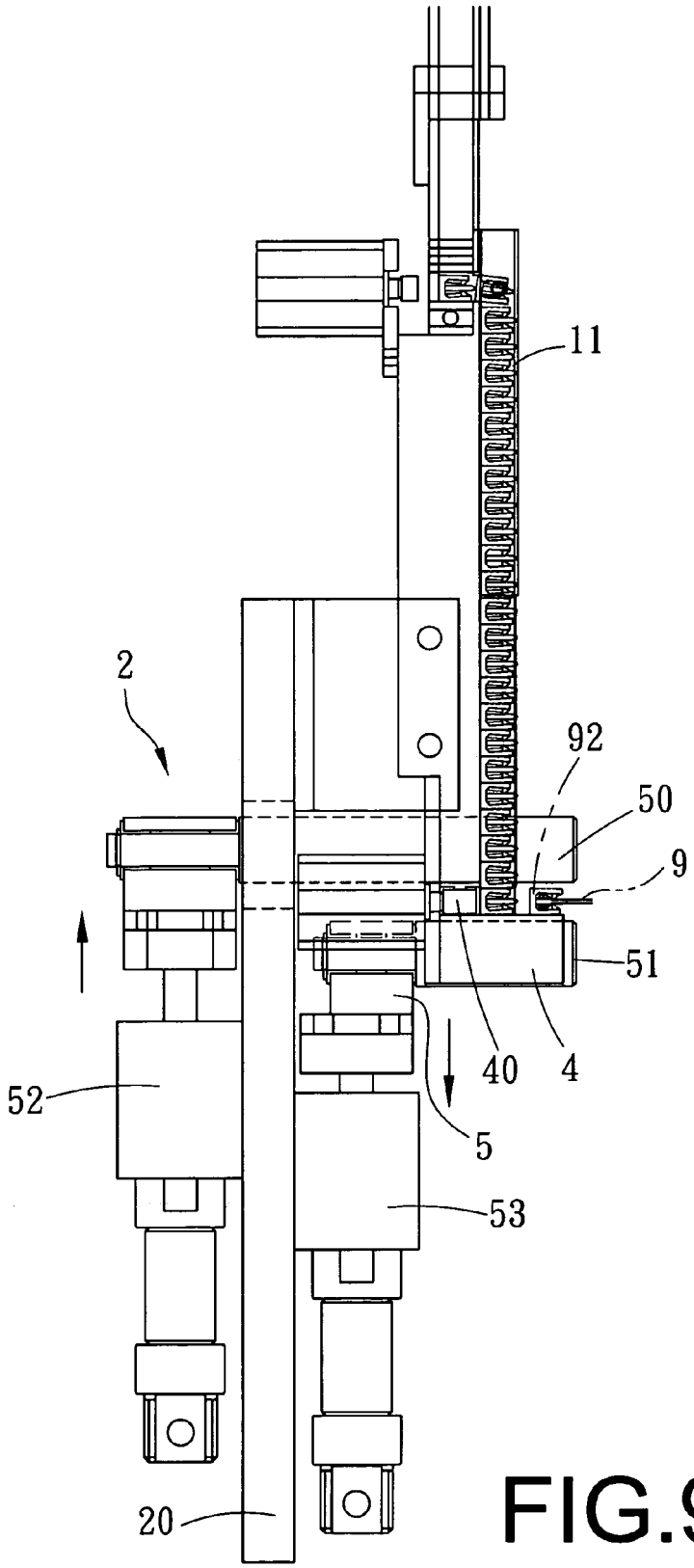
FIG. 9 is a lateral view of spreading the press unit of installation device of the present invention.

When the slide unit 92 of the clamping head is installed, the air pressure device 52 of the press unit 5 is upward to get the rolling wheel 50 moving upwards (referring to FIGS. 8 and 9). The other air pressure device 53 is downward to get the other rolling wheel 51 moving downwards so that the gap between the two rolling wheels 50 and 51 is increased. The slide unit 92 of the clamping head on the clamping portion 91 is available to pass through the gap. After the slide unit 92 of the clamping head passed through the gap between the rolling wheel 50 and rolling wheel 51, the two air pressure devices 52 and 53 return back so as to get the two rolling wheel 50 and 51 moving back to the original locations. By use of rolling the two rolling wheels 50 and 51 to press the opening clamping portion 91, the previously removing clamping portion 91 is in the closed state. Thereby, the procedure of assembly is continuous automatically so that the slide unit 92 of the clamping head is installed at the clamping portion 91 of the zipper bag 9 in quite short time. The assembly is convenient and fast so as to reduce manufacture cost and enhance productivity. Therefore, the present invention is economic and efficient.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An apparatus for inserting a slide unit of a clamping head on a zipper bag comprising:

a base frame (1); a vibration device (10), a track (11) and an installation device (2) installed on the base frame (1); wherein the installation device (2) includes a retaining seat (20); the retaining seat (20) includes a removing unit (3), an input unit (4) and a press unit (5), wherein said removing unit (3) includes a groove (30); a front side of said groove (30) having a notch (31) for receiving a clamping portion (91) of the zipper bag (9), wherein the closed clamping portion (91) of said zipper bag (9) can pass through said notch (31); a removing sheet (32) disposed within said groove (30) such that as said removing sheet (32) is removed by the closed clamping portion (91), an opening (90) of the zipper bag (9) is formed so that a slide unit (92) of a zipper clamping head can be placed therein;

the input unit (4) including a push rod (40) positioned below the track (11) with said push rod (40) being used to push forward and install the slide unit (92) onto the zipper bag (9) so as to form an opening on the clamping portion (91);

the press unit (5) being on one side of the input unit (4); the press unit (5) having two rolling wheels (50) and (51); and the two rolling wheels (50) and (51) being driven by two air pressure devices (52) and (53);

wherein during assembly of the zipper bag, the slide unit (92) is positioned in the vibration device (10) such that the clamping portion (91) is installed in the groove (30) by passing through installation device (2), wherein the closed clamping portion (91) is opened by the removing sheet (32) in the groove (30); and the slide unit (92) is vibrated and guided by means of the vibration device (10) along the track (11), wherein the track (11) delivers the slide unit (92) to the input unit (4) wherein the push rod (40) pushes the slide unit (92) forward to be installed and to open the clamping portion (91) of the zipper bag (9), wherein subsequent to the slide unit (92) being installed, the air pressure devices (52) and (53) are moved upward and downward respectively to move rolling wheels (50) and (51) upward and downward, respectively, in order to increase a gap between the two rolling wheels allowing the slide unit (92) of the clamping head of the clamping portion (91) to pass through the gap; wherein the two air pressure devices (52) and (53) are moved back allowing the two rolling wheels (50) and (51) to move back to their original locations to press the opened clamping portion (91) to a closed state.

* * * * *